US009586739B2

(12) United States Patent
Jego

(10) Patent No.: US 9,586,739 B2
(45) Date of Patent: Mar. 7, 2017

(54) BLANK AND PACKAGING FOR PACK OF POTS WITH CONNECTION/DEFORMATION SECTIONS

(71) Applicant: Fabien Jego, Saint Andre les Vergers (FR)

(72) Inventor: Fabien Jego, Saint Andre les Vergers (FR)

(73) Assignee: AUTOMATISATION ET RENOVATION DU CONDITIONNEMENT DANS LES INDUSTRIES LAITIERES ARCIL, Puiseux Pontoise (FR)

( * ) Notice: Subject to any disclaimer, the term of this patent is extended or adjusted under 35 U.S.C. 154(b) by 0 days.

(21) Appl. No.: 14/461,471

(22) Filed: Aug. 18, 2014

(65) Prior Publication Data

US 2015/0060533 A1 Mar. 5, 2015

(30) Foreign Application Priority Data

Aug. 30, 2013 (FR) ..... 13 58315

(51) Int. Cl.
*B65D 71/22* (2006.01)
*B65D 71/36* (2006.01)
(Continued)

(52) U.S. Cl.
CPC ..... *B65D 71/22* (2013.01); *B65B 5/024* (2013.01); *B65B 5/10* (2013.01); *B65D 71/14* (2013.01);
(Continued)

(58) Field of Classification Search
CPC ..... B65D 71/22; B65D 71/246; B65D 71/32; B65D 71/36; B65D 5/443
(Continued)

(56) References Cited

U.S. PATENT DOCUMENTS 3,162,351 A * 12/1964 Rudofski ..... B65D 5/001 206/586
5,439,112 A 8/1995 De Guglielmo et al.
7,922,069 B2 * 4/2011 Gardner ..... B65D 5/28 229/109

FOREIGN PATENT DOCUMENTS

EP 0 615 920 9/1994
GB 1010936 11/1965
(Continued)

OTHER PUBLICATIONS

French Search Report dated May 19, 2014, corresponding to the Foreign Priority Application No. 1358315.

*Primary Examiner* — Christopher Demeree
(74) *Attorney, Agent, or Firm* — Young & Thompson

(57) ABSTRACT

A blank includes:

a top panel, two side panels, a base panel, a closure panel, and a securing member for closing the erected blank on itself, four sets of corner post panels each extending from a side panel and able to be erected to form corner posts, a receiving portion extending over a portion of the base panel, for receiving the bottom walls of pots, delimited transversely by two intermediate base score lines which define, with the ends of the base panel, two connection/deformation sections on either side of the receiving portion. The intermediate base score lines form two deformable hinges, so that the receiving portion can be moved relative to the ends of the base panel along a vertical axis after formation of the packaging and the pack.

30 Claims, 6 Drawing Sheets

(51) Int. Cl.

| | |
|---|---|
| ***B65D 71/24*** | (2006.01) |
| ***B65D 71/32*** | (2006.01) |
| ***B65B 5/10*** | (2006.01) |
| ***B65B 5/02*** | (2006.01) |
| ***B65D 71/14*** | (2006.01) |

(52) U.S. Cl.
CPC ..... *B65D 71/246* (2013.01); *B65D 71/32* (2013.01); *B65D 71/36* (2013.01); *B65D 2571/0066* (2013.01); *B65D 2571/00141* (2013.01); *B65D 2571/00253* (2013.01); *B65D 2571/00438* (2013.01); *B65D 2571/00728* (2013.01); *B65D 2571/00839* (2013.01); *B65D 2571/00895* (2013.01); *B65D 2571/00913* (2013.01)

(58) Field of Classification Search
USPC ..... 229/103.2, 117.14, 122; 206/434
See application file for complete search history.

(56) References Cited

FOREIGN PATENT DOCUMENTS

| | | |
|---|---|---|
| GB | 1049681 | 11/1966 |
| GB | 2196608 | 5/1988 |
| JP | 2005-015019 | 1/2005 |
| WO | 2006/068523 | 6/2006 |
| WO | 2006/126873 | 11/2006 |
| WO | 2010/096536 | 8/2010 |

* cited by examiner

BLANK AND PACKAGING FOR PACK OF POTS WITH CONNECTION/DEFORMATION SECTIONS

FIELD OF THE INVENTION

The invention relates to the field of packaging for packs of pots, particularly tubular shell packaging of cardboard or similar material which is made by erecting a flat cardboard blank and closing it on itself.

The invention more specifically relates to a flat blank for a tubular shell of cardboard or the like, intended for forming packaging for a pack of pots including at least one layer of base pots and, optionally, one or more layers of pots stacked vertically on top of the layer of base pots, a method for creating such a pack, a packaging obtained by implementing the method, the pack created, and finally a production line for the creation of such a pack.

BACKGROUND OF THE INVENTION

A pot, such as the pot in the pack in question, comprises a bottom wall, a side wall closed on itself, and a top closure. In a simple embodiment, the pot is in the shape of a cylinder or truncated cone and comprises a transverse flange near its top opening, the top closure being a flat seal lid integral with and secured to the flange. In other embodiments, the generatrix of the side wall is a line other than a straight line, having a more or less complex shape, and the directrix is other than a circle, for example a curved square with rounded corners. The side wall of such a pot is rounded to meet the bottom wall and allow for some vertical deformation of the pot under vertical compression. In other embodiments, the pot can stand upright when resting on its bottom wall which forms its base, the side wall being adapted to deform by elastic bending within a certain range of vertical compression.

In one embodiment, such a pot is made of thermoformed plastic and has a certain strength enabling it to be self-supporting, but the pot may be made of other materials and by other processes.

Such a pot is typically designed to contain a content that may or may not be homogeneous, in a more or less generally fluid state which does not exclude the presence of more or less solid lumps. Such content is, for example, a milk product or a dessert, although this is not an exhaustive list.

In one embodiment, the pot is designed to receive a single serving of such content for individual use, for example about a hundred grams, and in this case, it may have an approximate height of several centimeters and fit within a cylinder also having an approximate diameter of several centimeters. In other embodiments, the pot is intended for a smaller serving and is reduced in size, or conversely is intended for a bigger serving and is larger.

Depending on the case, the pots are separate or are connected together, for example by their flanges, to form a group of pots.

In one possible basic embodiment, the pack comprises a single layer of base pots having an even number of pots, for example four pairs side by side and next to one another. In other embodiments, the pack comprises multiple (two, three . . . ) stacked layers of pots—including the base layer and a top layer. In still other embodiments, a layer comprises more than four pots and optionally an odd number of pots, in particular arranged in three or more longitudinal rows and two or more transverse rows.

In a manner known in particular from document JP 2005 015019, a packaging of cardboard or the like in tubular shell form, for such a pack of pots, is created from a flat blank comprising:

- side by side in a longitudinal direction: a top panel, two side panels, a base panel, a closure panel, and a securing means for closing the erected blank on itself,
- transverse score lines, extending in a transverse direction substantially perpendicular to the longitudinal direction, suitable and intended for folding the panels, for erecting the blank, and for forming the packaging and the pack,
- a receiving portion extending over a portion of the base panel, for receiving the bottom walls of the base pots.

To enable transporting a large number of packs created in this manner, for example stacks of packs arranged inside a container, it is desirable to increase the vertical compressive strength of the packs in order to prevent damage to the pots of the packs forming the base of the stack.

It is therefore provided that the cardboard blank also comprises four sets of corner post panels which can be erected to form corner posts to provide the packaging with good vertical compressive strength.

In the embodiment described in JP 2005 015019, each set of corner post panels extends from a transverse end of a side panel, with longitudinal score lines that are suitable and intended for folding the panels of the sets of corner post panels in order to erect the sets of corner post panels and form the erected corner posts.

This way, vertical compression is absorbed by the erected corner posts and not solely by the pots of the pack. The vertical compressive strength is thus improved. However, it would be advantageous to increase this compressive strength in order to allow transporting and storing larger stacks of packs without damage.

Patent WO 2006/126873 discloses a cardboard container comprising vertical tubular corner posts having a triangular cross-section and a height at least two times greater than the perimeter of said cross-section. This increases the stiffness and strength of the container.

The prior art is also illustrated in documents WO 2010/096536, GB 1,049,681, GB 1,010,936, GB 2,196,608, and WO 2006/068523.

Starting from the creation of the flat blank, known for the indicated purpose, which has a generally rectangular shape and can be used to form the packaging for a pack, of the tubular shell type of cardboard or the like, the pack including at least one layer of base pots and, optionally, one or more layers of pots stacked vertically on top of the layer of base pots, the blank comprising: side by side in a longitudinal direction, a top panel, two side panels, a base panel, a closure panel, and a securing means for closing the erected blank on itself; transverse score lines extending in a transverse direction substantially perpendicular to the longitudinal direction, suitable and intended for folding the panels, for erecting the blank, and for forming the packaging and the pack; four sets of corner post panels, each set of corner post panels extending from a transverse end of a side panel and able to be erected relative to said side panel so as to form an erected corner post; longitudinal score lines, suitable and intended for folding the panels of the sets of corner post panels, for erecting the sets of corner post panels, and for forming the erected corner posts; a receiving portion extending over a portion of the base panel, for receiving the bottom walls of the base pots; the problem underlying the invention is to improve the vertical compressive strength of the pack packaging. This problem also concerns high machinability at high speeds, with a reliable method and a production line which eliminates disadvantageous complexities.

A description of the invention as characterized is provided below.

OBJECTS AND SUMMARY OF THE INVENTION

A first aspect of the invention relates to a flat blank intended for forming a packaging for a pack of pots, the pots being of the type having a bottom wall, a side wall closed on itself, and a top closure, the pack including at least one layer of base pots and, optionally, one or more layers of pots stacked vertically on top of the layer of base pots, the blank being of the tubular shell type of cardboard or the like, comprising:

- side by side in a longitudinal direction: a top panel, two side panels, a base panel, a closure panel, and a securing means for closing the erected blank on itself,
- transverse score lines, extending in a transverse direction substantially perpendicular to the longitudinal direction, suitable and intended for folding the panels, for erecting the blank, and for forming the packaging and the pack,
- four sets of corner post panels, each set of corner post panels extending from a transverse end of a side panel and able to be erected relative to said side panel so as to form an erected corner post,
- longitudinal score lines, suitable and intended for folding the panels of the sets of corner post panels, for erecting the sets of corner post panels, and for forming the erected corner posts,
- a receiving portion extending over a portion of the base panel, for receiving the bottom walls of the base pots.

This blank is such that:

- the receiving portion is formed by a longitudinally median transverse portion of the base panel, and is bounded transversely on the base panel by two intermediate base score lines,
- the intermediate base score lines define, with the longitudinal ends of the base panel, two connection/deformation sections extending over the base panel on each side of the longitudinally median receiving portion of the base panel,
- the intermediate base score lines form two deformable hinges, such that the longitudinally median receiving portion of the base panel can be moved relative to the longitudinal ends of the base panel along an axis perpendicular or substantially perpendicular to the receiving portion after erection of the blank and formation of the packaging and the pack.

In one embodiment, a longitudinal dimension of a connection/deformation section—a distance between the intermediate base score line and the longitudinal end of the base panel defining the connection/deformation section—is between about 2% to 24%, more particularly about 12%, of a longitudinal dimension of the base panel—a distance between the longitudinal ends of the base panel.

In one embodiment, the blank comprises:

- two free edges in the longitudinal direction and two free edges in the transverse direction,
- arranged one after the other in the longitudinal direction: a closure panel, a first side panel, a base panel, a second side panel, a top panel, with means for securing the top panel to the closure panel in order to close the erected blank on itself with formation of a top wall,
- two end base score lines, between the base panel and the two side panels, and two top score lines, between the top panel and the closure panel and the two adjacent side panels,
- the base panel comprising, arranged one after the other in the longitudinal direction between a first and a second longitudinal end of the base panel: a first connection/deformation section, a receiving portion, and a second connection/deformation section,
- the base panel comprising two intermediate base score lines between the two connection/deformation sections and the receiving portion.

In one embodiment, the sets of corner post panels are substantially within the extension of the side panels, at their transverse ends.

For example, the side panels are substantially rectangular and each extend between a first and a second longitudinal end which are substantially rectilinear and parallel to each other, and between a first and a second transverse end which are substantially rectilinear and parallel to each other; the sets of corner post panels are substantially rectangular and each extend from a transverse end of a side panel between a first longitudinal end and a second longitudinal end which are substantially rectilinear and parallel to each other; the first and second longitudinal ends of the sets of corner post panels are substantially within the extension of the first and second longitudinal ends of the side panels.

In one embodiment, each set of corner post panels comprises at least three substantially rectangular post panels extending between the first and second longitudinal ends of said set of corner post panels; the post panels lie side by side in the transverse direction from one transverse end of a side panel from which the set of corner post panels extends, to a free transverse end of the set of corner post panels, a first post panel being connected to the transverse end of the side panel; the post panels are separated from each other and from the side panel by longitudinal score lines, suitable and intended for folding the post panels, for erecting the sets of corner post panels, and for forming the erected corner posts.

In one embodiment, each set of corner post panels comprises at its transverse free end an extreme post panel, suitable and intended for attachment to the side panel from which the set of corner post panels extends, once the set of corner post panels is erected.

For example, the blank comprises an outer surface and an inner surface which is suitable and intended for facing and accommodating the pack of pots once the blank is erected, and the extreme post panel is suitable and intended for securing to the inner surface of the side panel from which the set of corner post panels extends, once the set of corner post panels is erected.

In one embodiment, each set of corner post panels comprises, arranged one after the other in the transverse direction and separated by longitudinal score lines, a first post panel, a second post panel, and an extreme post panel; and a longitudinal dimension of the first post panel—the distance between the longitudinal score lines separating the first post panel from the second post panel and from the side panel—is less than a longitudinal dimension of the second post panel—the distance between the longitudinal score lines separating the second post panel from the first post panel and from the extreme post panel.

For example, the longitudinal dimension of the first post panel is between about 52% to 90%, more particularly about 70%, of the longitudinal dimension of the second post panel.

In one embodiment, each side panel is a single rigid portion.

In one embodiment, a longitudinal dimension of a side panel—a distance between the end base score line and the top score line of this side panel—is less than a height of the pack of pots with no load—a distance between the closures of the pots in the highest layer of the pack of pots in the vertical direction, and the bottom walls of the pots in the layer of base pots, when the pack of pots is not subjected to compression in the vertical direction.

For example, the longitudinal dimension of the side panel is between about 90% to 99%, more particularly about 96%, of the height of the pack of pots with no load.

In one embodiment, a longitudinal dimension of the base panel—a distance between the end base score lines—is substantially less than or equal to a longitudinal dimension of the top wall of the packaging, and in particular is substantially less than or equal to a longitudinal dimension of the top panel—a distance between the transverse free edge and the top score line of the top panel.

In one embodiment, the blank comprises two stiffening panels each extending from a transverse end of the top panel.

In one embodiment, the stiffening panels are substantially within the extension of the transverse ends of the top panel.

For example, the top panel is substantially rectangular and extends between a first and a second longitudinal end which are substantially rectilinear and parallel to each other, and between a first and a second transverse end which are substantially rectilinear and parallel to each other; the stiffening panels each extend from a transverse end of the top panel to a transverse free end, and extend between a first and a second longitudinal end which are substantially rectilinear and parallel to each other; the first and second longitudinal ends of the stiffening panels are substantially within the extension of the first and second longitudinal ends of the side panels.

According to one embodiment, the free transverse end of each stiffening panel has a general shape similar to or resembling that of a circular arc, such that a transverse length of the stiffening panel—a distance in the transverse direction between the free transverse end and the transverse end of the top panel from which the stiffening panel extends—is smaller at a longitudinal middle portion of the stiffening panel than at a longitudinal end of the stiffening panel.

In one embodiment, the closure panel is a narrow flap provided with adhesive.

In one embodiment, the top panel comprises at least one opening suitable for gripping when the blank is erected.

A second aspect of the invention relates to a method for creating a pack of pots, the pots being of the type having a bottom wall, a side wall closed on itself, and a top closure, the pack including at least one layer of base pots and, optionally, one or more layers of pots stacked vertically on top of the layer of base pots, packed in packaging created from a flat blank erected and closed on itself, wherein:

a flat blank as described above is provided, pots intended to be part of the pack are provided, in a pot arrangement step, the pots are placed on the blank in at least one layer of base pots, and optionally one or more layers of pots stacked in a height direction on top of the layer of base pots, so that the bottom walls of the base pots are received on the receiving portion of the blank, in a post formation step, four sets of corner post panels are erected relative to the side panels so as to form four erected corner posts by folding the panels of the sets of corner post panels around longitudinal score lines, in a blank formation step, the blank is erected around the pots by folding the side panels, the top panel, and the closure panel around transverse score lines, then, in a final step, the closure panel is secured so that is closes the erected blank on itself, thus forming the packaging for the pack of pots as well as the pack of pots.

Depending on which configuration is desired, the method is such that a blank according to the first embodiment described above is provided, and the extreme post panels of the sets of corner post panels are secured to the side panels.

Depending on which configuration is desired, the method is such that a blank according to the first embodiment described above is provided, and the first corner post panel pivots about the transverse end of the side panel to an angle of about 90°.

Depending on which configuration is desired, the method is such that a blank according to the first embodiment described above is provided, and each stiffening panel is folded over the erected corner posts of the transverse ends of the adjacent side panels and each stiffening panel is secured to said erected corner posts.

A third aspect of the invention relates to packaging obtained by implementing the method as described above, wherein each erected corner post extends in the vertical direction between a lower end and an upper end, and wherein a height of an erected corner post—a distance in the vertical direction between the lower end and the upper end of the erected corner post—is less than a height of the pack of pots with no load—a distance in the vertical direction between the closures of the pots in the vertically highest layer of pots of the pack of pots, and the bottom walls of the pots of the layer of base pots, the pack of pots not being subjected to compression in the vertical direction.

In one embodiment, when the pack of pots is not subjected to compression in the vertical direction, the lower ends of the erected corner posts are not in contact with the receiving portion of the blank.

For example, the lower ends of the erected corner posts are distanced from the receiving portion of the blank, in the vertical direction, by a substantially vertical separation distance of between about 1% to 12%, more particularly of about 4%, of a height of the erected corner posts—a distance, in the vertical direction, between the lower ends and the upper ends of the erected corner posts.

In one embodiment, when the pack of pots is subjected to compression in the vertical direction, the bottom walls of the pots of at least one layer of pots of the pack are deformed in the vertical direction such that the lower ends of the erected corner posts are in contact with the receiving portion of the blank.

For example, a height of the pack of pots under load—a distance, in the vertical direction, between the top closures of the pots in the vertically highest layer of pots of the pack of pots, and the bottom walls of the pots in the layer of base pots, said pack of pots being subjected to compression in the vertical direction—is equal to a height of the erected corner posts—a distance, in the vertical direction, between the lower ends and the upper ends of the erected corner posts.

In one embodiment, the vertical compression exceeds 8 kg, in particular exceeds 12 kg.

Depending on which configuration is desired, the packaging is created from a blank according to the first embodi ment described above, and, for a set of corner post panels erected to form an erected corner post, the first post panel forms an angle of about 90° with the side panel from which the set of corner post panels extends, the second post panel forms an angle of approximately 47° with the first post panel, the extreme post panel forms an obtuse angle of about 135° with the second post panel, and is substantially coplanar with the side panel from which the set of corner post panels extends.

Depending on which configuration is desired, the packaging is created from a blank according to the first embodiment described above, and each stiffening panel is secured to two first post panels of two adjacent sets of corner post panels, where appropriate at the first and second longitudinal ends of said stiffening panel.

A fourth aspect of the invention relates to a pack of pots which includes at least one layer of base pots and, optionally, one or more layers of pots stacked vertically on top of the layer of base pots, the pots being of the type having a bottom wall, a side wall closed on itself, and a top closure; and a packaging according to the third embodiment described above, wherein:

the bottom walls of the base pots are received on the receiving portion, and the top wall rests against or is adjacent to the top closure of the pots in the vertically highest layer of pots of the pack of pots.

According to one embodiment, the bottom walls of the pots of at least one layer of pots of the pack are rounded and able to deform elastically in the vertical direction when the pack of pots is subjected to compression in the vertical direction.

According to one embodiment, the side walls of the pots of at least one layer of pots of the pack are able to deform elastically in the vertical direction when the pack of pots is subjected to compression in the vertical direction.

According to one embodiment, the compression in the vertical direction exceeds 8 kg, in particular exceeds 12 kg.

According to one embodiment, some pots comprise a flange near the top closure, the flange having a shape complementary to a shape of the erected corner posts, in particular a geometric shape with angled corners.

Depending on which configuration is desired, the pack comprises packaging according to the third embodiment described above, and the flanges of the pots have angled corners cooperating with the second panel of the erected corner posts.

In one embodiment, the layer of base pots consists of at least eight base pots.

A fifth and final aspect of the invention relates to a production line for creating a pack of pots as described above, which comprises:

means for providing flat blanks as previously described, means for providing pots intended to be part of the pack, conveying means associated with the means for providing flat cardboard blanks and the means for providing pots, said conveying means being arranged generally horizontally and being suitable for conveying flat blanks, blanks with pots resting on them, and packaging materials, with functional means along its length comprising:

means for gripping, moving, and arranging pots, suitable and intended for arranging the pots in at least one layer of base pots, and optionally one or more layers of pots stacked in a height direction on top of the layer of base pots such that the bottom walls of the base pots are received on the receiving portion of the blanks on the conveying means, folding means, suitable and intended for erecting the sets of corner post panels relative to the side panels of the blanks, so as to form the erected corner posts by folding the panels of the sets of corner post panels around the longitudinal score lines, folding means, suitable and intended for erecting the blanks around the pots by folding the side panels, top panels, and closure panels around the transverse score lines, closure and securing means, suitable and intended for securing the closure panels so as to close the erected blanks on themselves and thus form the packaging for packs of pots as well as the packs of pots, and means for removing the packs.

The advantages of the invention over the prior art are that the lower ends of the erected corner posts of the pack of pots are not in contact with the receiving portion of the blank when the pack of pots is not subjected to compression in the vertical direction. Therefore when the pack of pots is subjected to compression in the vertical direction, the force exerted is first absorbed by elastic deformation in the vertical direction, of the pots in the pack of pots. When the vertical compression is increased, the lower ends of the erected corner posts come in contact with the receiving portion of the blank such that the erected corner posts of the pack of pots are able to absorb an additional portion of the vertically exerted force. In this manner, the vertical compressive strengths of the pack of pots and of the corner posts are added to each other rather than competing against each other. In addition, this is achieved in a manner that allows high machinability at high speeds and reliability, with a production line that avoids disadvantageous complexities.

We will now briefly describe the figures in the drawings.

MORE DETAILED DESCRIPTION

The following is a detailed description of several embodiments of the invention, with examples and with references to the drawings.

Figure 1:
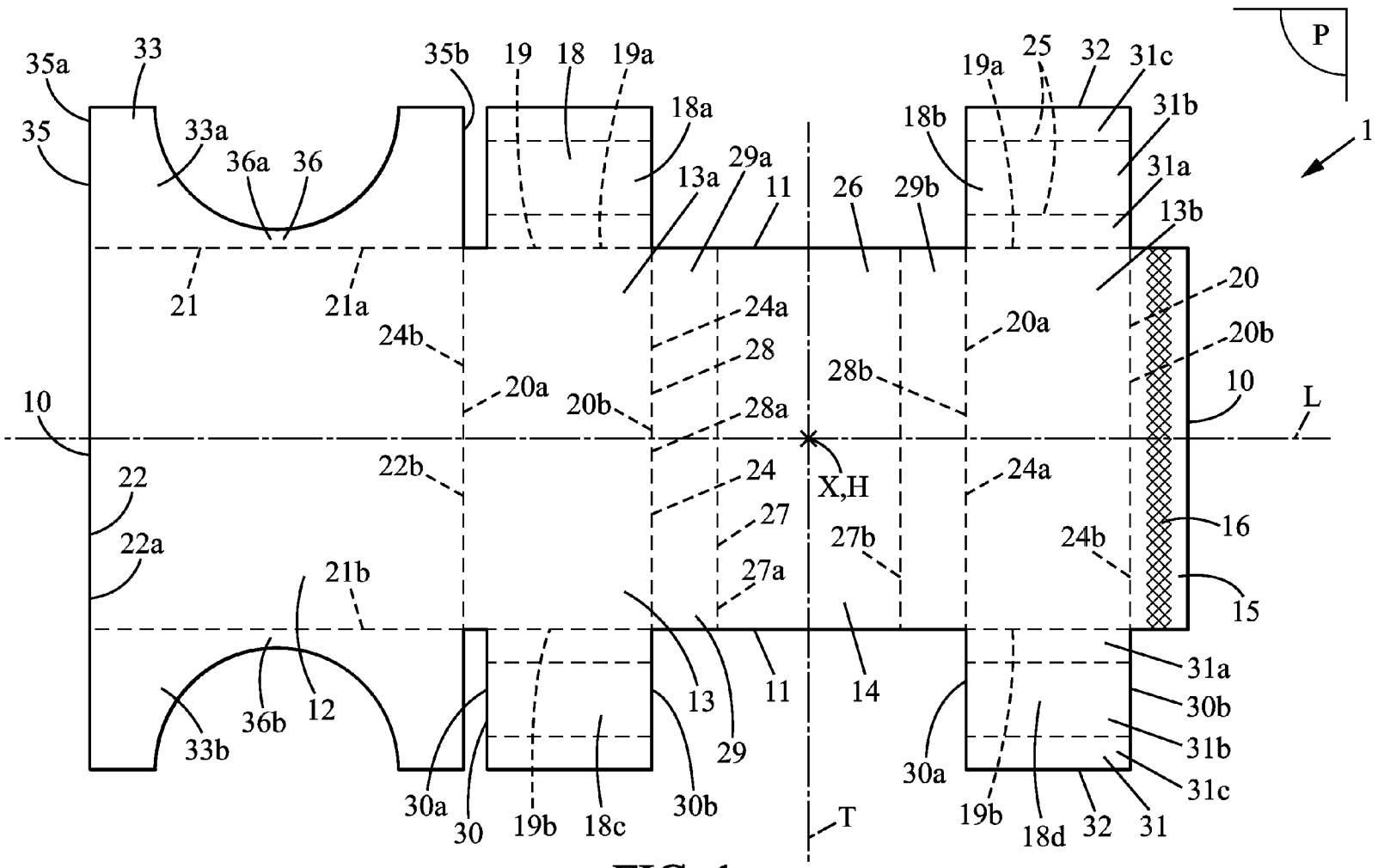
FIG. 1 is an elevated view of a possible embodiment of the blank according to the invention, shown in its flat configuration, intended for the creation of a pack having a single base layer of eight base pots, arranged in two aligned rows of four pots side by side and next to one another, in accordance with the invention.
Figure 2:
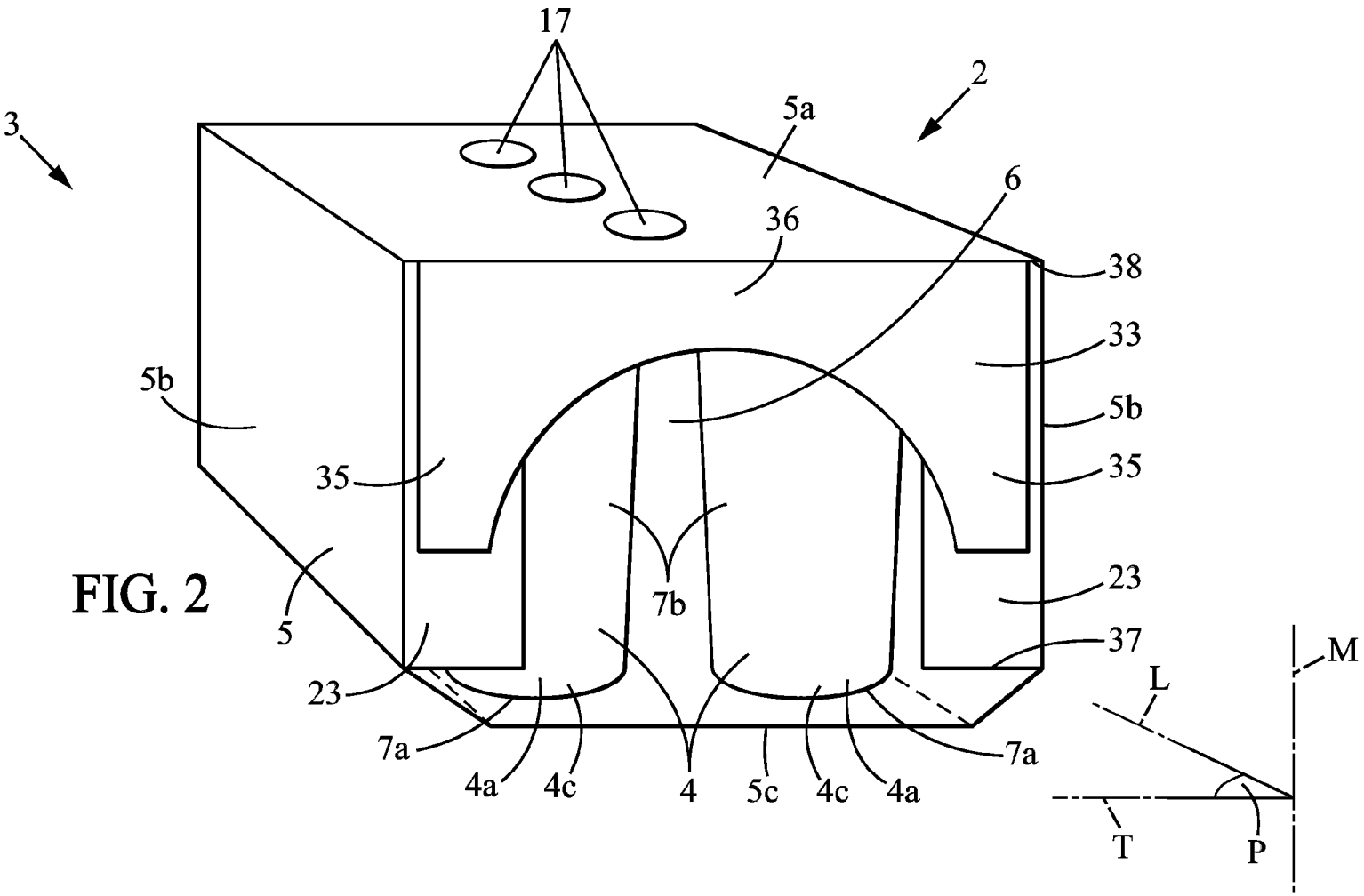
FIG. 2 is a top perspective view of the packaging for a pack having a single base layer of eight base pots, created from a blank such as the one in FIG. 1 by carrying out the method for creating a pack according to the invention, specifically illustrating the panel comprising the connection/deformation sections on either side of a longitudinally median receiving portion, separated by intermediate base score lines forming two deformable hinges, such that the longitudinally median receiving portion of the base panel can be moved relative to the longitudinal ends of the base panel along an axis perpendicular to the receiving portion after erection of the blank and formation of the packaging and pack.
Figure 6:
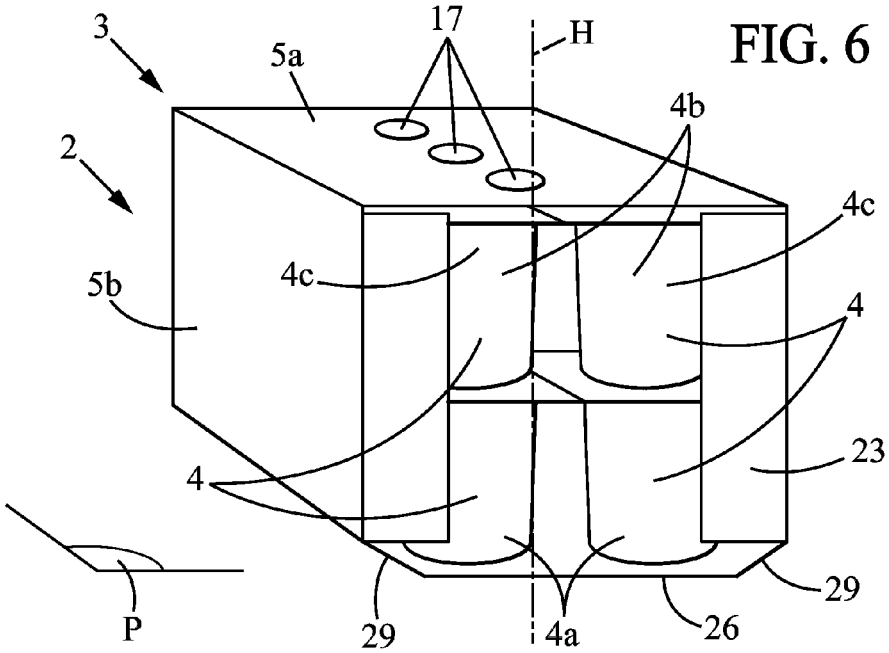
FIG. 6 is a bottom perspective view of an alternative embodiment of the blank, the packaging, and the blank pack according to the invention, the pack having two layers of eight pots each, a layer of base pots having eight base pots and a stacked layer of pots having eight stacked pots.

A flat blank 1 (a blank in its flat configuration) as shown in FIG. 1 is intended for forming a packaging 2 that is part of a pack 3 which also comprises pots 4 as shown in FIG. 2 and FIG. 6.

The packaging 2 is a tubular shell of cardboard or the like and is formed by erecting the blank 1 and closing it on itself, so that it fits snugly against the pots 4 of the pack 3 and keeps them grouped together.

"Tubular shell" is understood to mean that the packaging 2, generally having six faces and geometrically inscribed within a generally parallelepiped shape, has four adjacent faces or walls closed on themselves 5, which include a top wall 5*a*, two longitudinal side walls 5*b*, and a bottom wall 5*c*, and two open faces or walls 6 opposite one another that constitute two transverse side walls.

The term "pack" is understood to mean a batch formed of a plurality of pots 4 grouped into layer(s)—superimposed if there is a plurality of layers—in longitudinal rows and transverse rows, within packaging such as the tubular shell of cardboard or the like as in the current case, forming a unit assembly intended to be stored, handled, moved, displayed for sale, and sold as such.

The pots 4 comprised in the pack 3 comprise at least base pots 4*a*. The term "base pot 4*a*" is intended to distinguish such a pot from any other pot in the pack 3, meaning a pot in a stacked layer of pots 4*b* as shown in FIG. 6.

The description with reference to FIGS. 1 to 8 relates to the specific embodiment of a pack 3 of pots 4 having a base layer of eight base pots 4*a* arranged in two rows of four pots, aligned and side by side.

However, in a basic embodiment of the invention, a basic blank 1 and a basic packaging 2 may be such that a basic pack 3 of pots 4 has a layer of base pots 4*a* with four base pots 4*a* arranged in pairs side by side and next to one another, arranged in a square.

More generally, the invention also relates to any blank 1, any packaging 2, and any pack 3, created from or comprising or derived from such a basic blank 1, such a basic packaging 2, and such a basic pack 3. Thus, a pack 3 may comprise a layer of pots 4*b* stacked vertically on top of the layer of base pots as shown in FIG. 6. The stacked pots 4*b* of the stacked layer of pots can be arranged similarly to the pots in the base layer 4*a* and be vertically aligned with the base pots 4*a*, meaning in a rectangle, with two rows of four pots placed next to one another. More generally, a pack 3 may comprise a plurality of layers of pots 4*b* stacked vertically on top of one another and on top of the layer of base pots 4*a*. In some embodiments, the layer of base pots and, where appropriate, the stacked layers of pots, may have more pots than the four base pots 4*a*, for example six, nine, or sixteen pots per layer of pots. In all possible embodiments within the scope of the invention, the pack 3 includes the base pots 4*a* of the layer of base pots of the basic pack, in accordance with the invention.

The terms "vertical", "vertically", and "in the vertical direction" refer to a particular position of the pots, the blank, the packaging, and the pack of pots, as illustrated for example in FIGS. 2 and 6. However, these terms are in no way limiting and said pots, blank, packaging, and pack of pots according to the invention may also have any other possible position.

The pots of the vertically uppermost layer in the pack of pots are the top pots 4*c*. In an embodiment in which a pack only comprises a layer of base pots 4*a* and no stacked pots 4*b*, the uppermost layer of the pack of pots is the layer of base pots and the base pots 4*a* will also be the top pots 4*c*. In another embodiment, the uppermost layer of the pack of pots is a stacked layer of pots in which the pots are then the top pots 4*c*.

The numeric reference 4 generically indicates the pots of a pack 3.

As the pack 3 always comprises a layer of base pots, it always comprises a layer of top pots. When the package 3 only contains one layer of pots (FIGS. 1 to 8), the layer of base pots and the layer of top pots form the same single layer of pots. When the pack 3 comprises two layers (FIGS. 9 to 11), the layer of base pots and the layer of top pots are different, the pots in the top layer being superimposed on the pots in the layer of base pots. Lastly, the pack 3 may contain three or more layers of pots, in which case it then has one or more intermediate layers of pots.

"Cardboard or the like" is understood to mean a layered material, such as the material commonly used or adapted for a blank having the specified purpose. Such cardboard should be neither too rigid nor too flexible. It must be able to be folded at score lines provided for this purpose. Another material having similar properties of rigidity, for example a plastic or a polymer, may also be used.

"Pot" 4 is understood to mean a container as described in the introductory section, its characteristics therefore not needing to be described again here, bearing in mind that such a pot 4, which has a certain strength enabling it to be freestanding, comprises a bottom wall 7*a*, a side wall closed on itself 7*b* with an opening opposite the bottom, and a top closure 8 typically such as a seal lid placed on and secured to a flange 9 projecting radially around the opening. Depending on the case, the pots 4 may be separate, or be connected together, for example by their flanges 9, to form a group of pots 4. Within the context of the invention, the pots 4 of a given pack 3 are similar, particularly identical, and are filled with a certain content which may or may not be the same for the different pots 4, and are sealed.

"Flat" in the term "flat blank" is understand to mean that the blank 1 is deployed so as to lie at least substantially in one plane P. Unless expressed otherwise, the term "blank" 1 without further clarification should be understood as referring to the blank 1 in the flat configuration, as opposed to the erected blank 1 which then acts as the packaging 2.

We will now refer to FIGS. 1 to 8 concerning the case of a basic pack 3 having a single base pot layer of four base pots 4*a* in pairs side by side and next to one another, arranged in a square.

With respect to the blank 1 in the plane P, we can define a longitudinal direction and a transverse direction, perpendicular to each other, and a direction perpendicular or substantially perpendicular to the plane P.

The blank 1 is generally rectangular in shape and is bounded by two free edges 10 in the longitudinal direction and two free edges 11 in the transverse direction. In the illustrated embodiment, the free edges 10, 11 are rectilinear edges, but in other embodiments they may not be, for example being scalloped. The two free edges 10 define the two edges of the two open faces 6 of the packaging 2 which are opposite one another.

The blank 1 comprises, arranged one after the other in the longitudinal direction, and between the two transverse edges 11, extending transversely, a top panel 12, a first side panel 13*a*, a base panel 14, a second side panel 13*b*, and a closure panel 15.

"Panel" is understood to mean a flat layered piece, in this case of cardboard or the like, bounded by a border comprising score lines and/or cut lines.

The blank 1 also comprises means 16 for securing the top panel 12 and the closure panel 15 to each other in order to close the erected blank 1 on itself to form a top face 5*a*. For example, the top panel 12 is wide (longitudinally) to form the entire face of the top panel 12, while the closure panel 15 is narrow (longitudinally) like a flap, is provided with fastening adhesive 16, and is able to come over the front of the top panel 12 at its free transverse edge 11. such an embodiment does not exclude others, for example a top panel 12 and a closure panel 15 having similar dimensions or a securing means in which tabs and notches cooperate.

According to a possible, non-limiting embodiment, the side panels 13, 13*a*, 13*b* are substantially rectangular and each extend between a first longitudinal end and a second longitudinal end 20, 20*a*, 20*b*, 20*c*, 20*d* and between a first transverse end and a second transverse end 19, 19*a*, 19*b*, 19*c*, 19*d*.

Thus, for each side panel 13, both longitudinal ends 20 defining said panel are substantially rectilinear and parallel to each other and, similarly, the two transverse ends 19 defining said panel are substantially rectilinear and parallel to each other.

The blank 1 is such that the two side panels 13*a* and 13*b* have the same dimension in the longitudinal direction. In addition, each side panel 13, 13*a*, 13*b* is a single rigid portion.

Similarly, in one possible embodiment, the top panel 12 is substantially rectangular and extends between a first longitudinal end and a second longitudinal end 21, 21*a*, 21*b* which are substantially rectilinear and parallel to each other, and between a first transverse end and a second transverse end 22, 22*a*, 22*b* which are substantially rectilinear and parallel to each other.

The top panel 12 may also be a single rigid portion and have openings 17 suitable for a user to grip the pack 3 of pots when the blank 1 is erected.

The blank 1 also comprises four sets of corner post panels 18, 18*a*, 18*b*, 18*c*, 18*d*, each set of corner post panels extending from a transverse end 19, 19*a*, 19*b*, 19*c*, 19*d* of a side panel 13, 13*a*, 13*b*. The sets of corner post panels can be erected relative to said side panel 13, so as to form an erected corner post 23.

The order and arrangement of panels may be different from that described above and may comprise, for example, arranged one after the other in the longitudinal direction, extending transversely between the two transverse edges 11, a first side panel 13*a*, a base panel 14, a second side panel 13*b*, a top panel 12, and a closure panel 15, the securing means 16 being a means of securing a side panel 13 and the closure panel 15, or the base panel 14 and the closure panel 15, to each other in order to close the erected blank 1 on itself to form a top face 5*a*.

Other arrangements in the longitudinal succession of panels are also conceivable, for example in which the securing means 16 is a means for securing the base panel 14 and the closure panel 15 together. These variants of the invention are not described further.

The blank 1 also comprises transverse score lines 24 and longitudinal score lines 25. The transverse score lines 24 are suitable and intended for the relative folding of the panels 12, 13, 14 and 15, for erecting the blank 1, and for forming the packaging 2 and the pack 3, while the longitudinal score lines 25 are suitable and intended for the relative folding of the panels of the sets of corner post panels 18, for erecting the sets of corner post panels 18, and for forming the erected corner posts 23.

The transverse score lines 24 of the blank 1 thus comprise in particular two end base score lines 24*a* between the base panel 14 and the two side panels 13, and two top score lines 24*b* between the top panel and the closure panel 12, 15 and the two side panels 13.

Such score lines are well known in the field of packaging and cardboard, and allow the relative folding of two adjacent panels at a predefined location. Such score lines are formed by the use of a scoring tool. It is understood that the term "score line" must be understood in the broadest sense, meaning that the line is suitable and intended for the relative folding of two adjacent panels.

The blank 1 comprises, in the plane P, a longitudinal centerline L in the longitudinal direction L, and a transverse centerline T in the transverse direction, with an intersection X. The blank 1 also comprises a normal axis H, perpendicular or substantially perpendicular to the plane P. This axis H is also called the vertical axis or elevation axis of the packaging 2. This axis H is again perpendicular or substantially perpendicular to the plane of movement of the conveyor means and of the conveyor means themselves, of the production line for creating packs 3. When the packs 3 are being formed or are in the usual storage and display position, the axis H is vertical or substantially vertical. The blank 1 is symmetrical or substantially symmetrical about the longitudinal centerline L. It is symmetrical or substantially symmetrical about the transverse centerline, if one disregards the top 12 and closure 15 panels. As for the intersection X, it is located substantially at the center of the base panel 14.

The blank 1 also comprises a receiving portion for pots 26, suitable and intended for receiving the bottom walls 7*a* of base pots 4*a*. It should be understood by this that each base pot 4*a* rests on the receiving portion 26 by its bottom wall 7*a*, particularly the center of said wall in the case where the bottom wall 7*a* is convex and curves towards the outside of the pot 4. Alternatively, each base pot 4*a* may rest on the receiving portion 26 along the periphery of its bottom wall 7*a*, particularly in the case where the bottom wall 7*a* is concave curving towards the inside of the pot 4.

The receiving portion for pots 26 (sometimes abbreviated to "receiving portion 26") entirely extends over a portion 14*a*, or a part 14*a*, of the base panel 14. More particularly, the receiving portion 26 is formed by a longitudinally median transverse portion 14*a* of the base panel 14, which is bounded transversely on the base panel 14 by a first and a second intermediate base score line 27, 27*a*, 27*b*.

"Longitudinally median transverse portion" 14*a* is understood to mean: firstly that the receiving portion 26 extends in the transverse direction over the entire base panel joining the free edges 11, while it only extends in the longitudinal direction over a portion of the two longitudinal ends 28, 28*a*, 28*b* of the base panel 14 and not over the entirety of this space; and secondly that the receiving portion 26 extends in the transverse direction, being arranged axially or substantially axially relative to the transverse centerline T.

For brevity, a portion which extends and is arranged transversely medianly, and is arranged longitudinally medianly, is referred to as a "longitudinally median transverse portion."

The intermediate base score lines 27, 27*a*, 27*b* extend in the transverse direction. They define, with the first and second longitudinal end 28, 28*a*, 28*b* of the base panel 14, two connection/deformation sections 29, 29*a*, 29*b* extending over the base panel 14, on either side of the longitudinally median receiving portion 26 of the base panel 14.

Thus, a first connection/deformation section 29*a* extends transversely over the entire length of the base panel 14 and longitudinally between the first intermediate base score line 27*a* and the first longitudinal end 28*a* of the base panel 14, while a second connection/deformation section 29*b* also extends transversely over the entire length of the base panel 14, and longitudinally between the second intermediate base score line 27*b* and the second longitudinal end 28*b* of the base panel 14.

In general, the base panel 14 thus comprises, arranged one after the other in the longitudinal direction between the first and the second longitudinal end 28*a*, 28*b* of the base panel 14, the first connection/deformation section 29*a*, the receiving portion 26, and the second connection/deformation section 29*b*, the two intermediate base score lines 27*a*, 27*b*, respectively separating the receiving portion 26 from the first and second connection/deformation sections 29*a*, 29*b*.

In one possible embodiment, the longitudinal dimension of a connection/deformation section 29, which corresponds to a distance between the intermediate base score line 27 and the longitudinal ends 28 of the base panel 14 defining the connection/deformation section 29, is between about 2% to 23%, more particularly about 10%, of the longitudinal dimension of the base panel 14, which corresponds to a distance between the longitudinal ends 28*a*, 28*b* of the base panel 14.

For example, the longitudinal dimension of a connection/deformation section 29 can be about 1 cm to 3 cm, for example 2 cm.

As will be further described below, the intermediate base score lines 27 form two deformable hinges, such that the longitudinally median receiving portion 26 of the base panel 14 can be moved relative to the longitudinal ends 28 of the base panel 14 along the vertical axis H perpendicular or substantially perpendicular to the receiving portion 26 after erection of the blank 1 and formation of the packaging 2 and of the pack 3.

The sets of corner post panels 18 are, and extend, substantially within the extension of the side panels 13, at their transverse ends 19.

Thus, according to a possible, non-limiting embodiment, the sets of corner post panels 18 are substantially rectangular and each extend from a transverse end 19 of a side panel 13 between a first longitudinal end and a second longitudinal end 30, 30*a*, 30*b* which are substantially rectilinear and parallel to each other, the first and second longitudinal ends 30, 30*a*, 30*b* of the sets of corner post panels 18 being substantially within the extension of the first and second longitudinal ends 20, 20*a*, 20*b* of the side panels.

More specifically, in one embodiment of the invention, each set of corner post panels 18 comprises at least three post panels 31, 31*a*, 31*b*, 31*c* which are substantially rectangular and extend between the first and second longitudinal ends 30*a*, 30*b* of the set of corner post panels. These post panels 31 lie side by side in the transverse direction from the transverse end 19 of the side panel 13 from which the set of corner post panels 18 extends, to a transverse free end 32 of the set of corner post panels 18.

In one possible embodiment, each set of corner post panels 18 has, arranged one after the other in the transverse direction and separated by longitudinal score lines 25, a first post panel 31*a*, a second post panel 31*b*, and an extreme post panel 31*c*.

The first post panel 31*a* is connected to the transverse end 19 of the side panel 13 from which the set of corner post panels 18 extends, while the extreme post panel 31*c* extends to the free transverse end 32 of the set of corner post panels 18. The post panels 31 are thus separated from each other and from the side panel 13 by longitudinal score lines 25.

The score lines 25 are suitable and intended for folding the post panels 31, for erecting the sets of corner post panels 18, and for forming the erected corner posts 23. The extreme post panel 33 is thus suitable and intended for attachment to the side panel 13 from which the set of corner post panels 18 extends, once the set of corner post panels is erected.

Figure 4B:
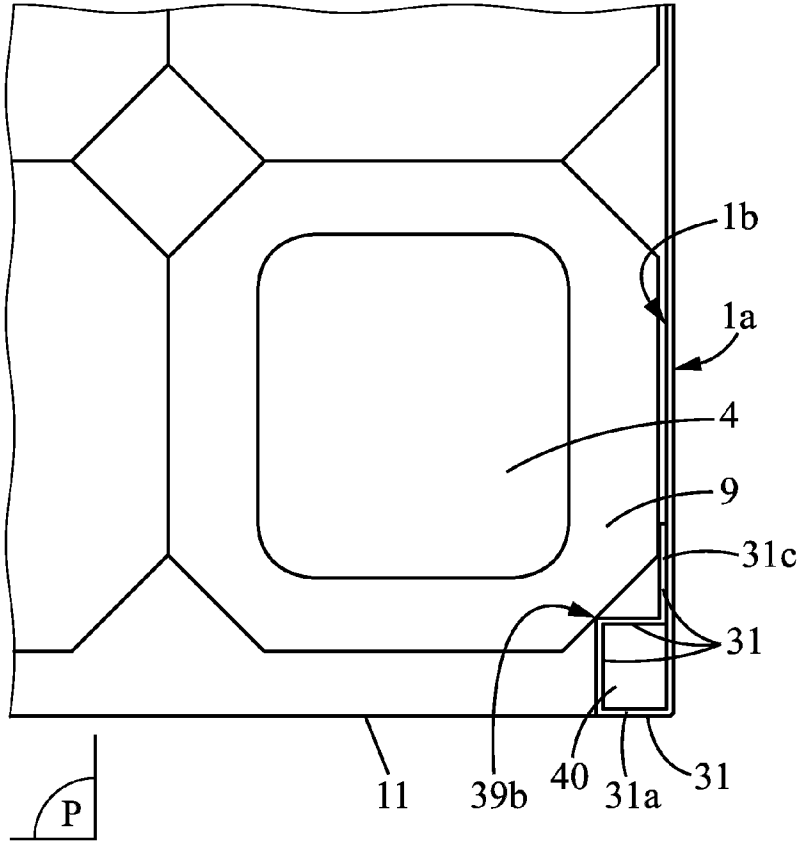
FIG. 4B is a partial enlargement of a cross-section of a variant of the pack of FIGS. 3A and 3B, viewed from below, specifically showing the shape of an erected corner post and the cooperation between this post and an adjacent pot of a layer of pots in the pack.
Figure 4A:
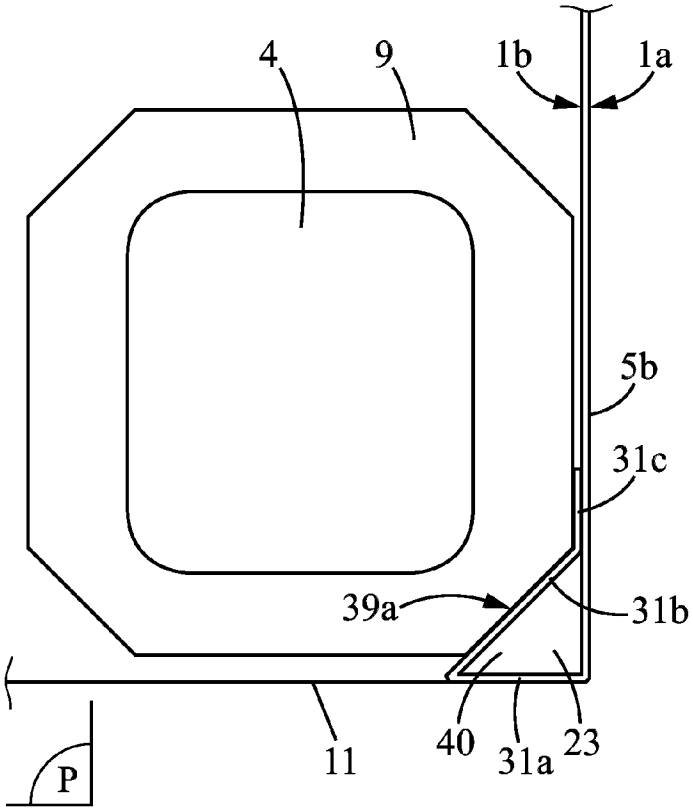
FIG. 4A is a partial enlargement of a cross-section of the pack of FIGS. 3A and 3B, viewed from below, specifically showing the shape of an erected corner post and the cooperation between this post and an adjacent pot of a layer of pots in the pack.

As shown in FIGS. 4A and 4B, the blank 1 may comprise an outer surface 1*a* and an inner surface 1*b* suitable and intended to face and accommodate the pots 4 once the blank 1 is erected. In this embodiment, once the set of corner post panels is erected, the extreme post panel 33 can be adapted and intended to be secured to the inner surface 1*b* of the side panel 13 from which the set of corner post panels 18 extends.

To this end, a transverse dimension of the first post panel 31*a*, which corresponds to the distance between the longitudinal score lines 25*a*, 25*b* respectively separating the first post panel 31*a* from the second post panel 31*b* and from the side panel 13 from which the set of corner post panels 18 extends, is less than a transverse dimension of the second post panel 31*b*, which corresponds to the distance between the longitudinal score lines 25*b*, 25*c* respectively separating the second post panel 31*b* from the first post panel 31*a* and from the extreme panel post 31*c*.

More specifically, the transverse dimension of the first post panel 31*a* is between about 50% to 90%, more particularly about 70%, of the transverse dimension of the second post panel 31*b*.

In one possible embodiment, the transverse dimension of the first post panel 31*a* may be about 2 cm to 3 cm, the transverse dimension of the second post panel 31*b* about 3 cm to 4 cm, and the transverse dimension of the extreme post panel 31*c* may be about 1 cm to 2 cm.

Figure 3B:
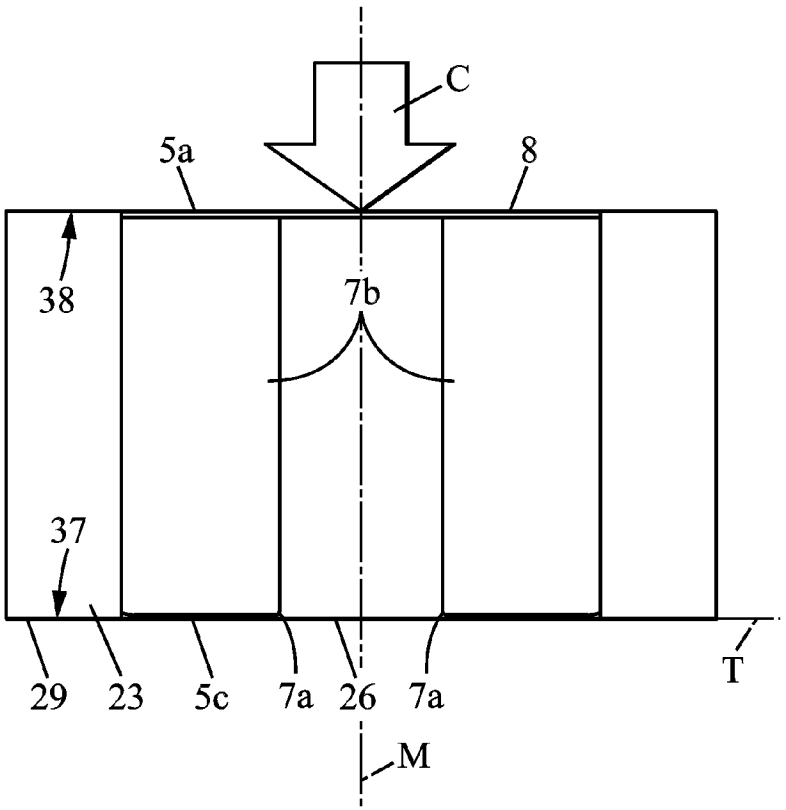
FIG. 3B is a front view of the pack of FIG. 3A, when the pack is subjected to sufficient vertical compression (arrow C) to bring the lower ends of the erected corner posts into contact with the receiving portion of the blank, illustrating in particular that the lower ends of the erected corner posts come in contact with the receiving portion of the blank, the vertical compressive strength of the erected corner posts then being added to the vertical compressive strength of the pots in the pack of pots.
Figure 3A:
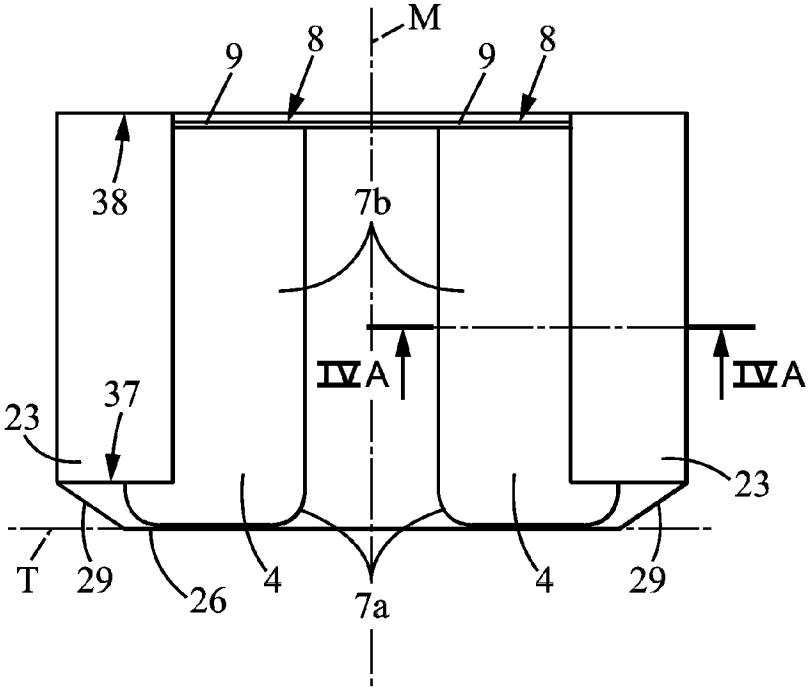
FIG. 3A is a front view of a pack with a single layer of base pots, created, using a variant of the blank of FIGS. 1 and 2 having no stiffening panels, by carrying out the method for creating a pack according to the invention when the pack is not subjected to vertical compression, illustrating in particular that the lower ends of the erected corner posts are not in contact with the receiving portion of the blank when the pack of pots is not subjected to compression in the vertical direction.

As illustrated in FIG. 3A, the longitudinal dimension of a side panel 13 corresponds to a distance between the end base score line 24*a* and the top score line 24*b* of this side panel 13. This dimension is less than the height of the pack of pots with no load, which corresponds to the distance between the closures 8 of the pots 4 in the layer of stacked pots 4*c* of the pack of pots, and the bottom walls 7*a* of the pots 4 in the layer of base pots 4*a*, the pack 3 of pots not being subjected to compression in the vertical direction.

"Pack of pots not being subjected to compression in the vertical direction" (sometimes abbreviated to "pack of pots with no load") is understood to mean the pack 3 when it is not subjected to any compression in the vertical direction or is subjected to weak compression with respect to the vertical compressive strength of the pack of pots 3. For example, these expressions can be understood to mean the pack 3 of pots when it is subjected to a compression in the vertical direction not exceeding 10 kg, in particular not exceeding 6 kg, this compression being applied in a uniformly distributed manner over the top walls 5*a* and bottom walls 5*c* of the pack 3 of pots once formed and assembled.

This compression in the vertical direction may be, for example, a compression in the vertical direction as applied during implementation of the methods commonly used to measure vertical compressive strength or "VCS", for example during implementation of the methods as specified in the ISO 12048:1994 or ASTM D642-00 (2010) standards.

The longitudinal dimension of each side panel 13 is thus between about 90% to 99%, more particularly about 96%, of the height of the pack of pots with no load.

As for the longitudinal dimension of the base panel 14, which corresponds to the distance between the two end base score lines 24*a*, this is substantially less than or equal to the longitudinal dimension of the top wall 5*a* of the packaging 2. In particular, the longitudinal dimension of the base panel 14 may be substantially less than or equal to the longitudinal dimension of the top panel 12, which corresponds to the distance between the transverse free edge 11 of the top panel 12 and the top score line 24*b* of the top panel 12.

Thus, in one possible embodiment where the pots 4 are intended to receive single servings of content for individual use, with a height of the pot 4 in the axial direction—between its bottom portion 7*a* and its top closure 8—of about 11 cm to 12 cm, and a cylindrical side wall 7*b* having a diameter of about 6 cm to 9 cm, the longitudinal dimension of the top panel 12 may be about 18 cm to 19 cm, the longitudinal dimension of the base panel 14 about 18 cm to 19 cm, the longitudinal dimension of the side panels 13, 13*a*, 13*b* about 11 cm to 12 cm, and the longitudinal dimension of the closure panel 15 about 2 cm to 3 cm, the flat blank 1 having a total longitudinal dimension of about 60 cm to 65 cm and a total transverse dimension of about 36 to 37 cm. Such an embodiment is not limiting.

The blank 1 may also comprise two stiffening panels 33, 33*a*, 33*b*, each extending from a transverse end 21, 21*a*, 21*b* of the top panel 12.

These panels 33 are substantially within the extension of said transverse ends 21 and extend to a free transverse end 34, 34*a*, 34*b*. Longitudinally, each stiffening panel 33 extends between a first longitudinal end and a second longitudinal end 35, 35*a*, 35*b* which are substantially rectilinear and parallel to each other. The first and second longitudinal ends 35, 35*a*, 35*b* of each stiffening panel 33 are substantially in the respective extensions of the first and second longitudinal ends 22, 22*a*, 22*b* of the top panel.

Here, the phrase "first and second longitudinal ends of each stiffening panel are substantially in the respective extensions of the first and second longitudinal ends of the top panel" is understood to mean that the longitudinal ends 35 of each stiffening panel 33 are parallel to the longitudinal ends 22 of the top panel 12, and that a transverse distance between a longitudinal end 35 of a stiffening panel 33 and the nearest longitudinal end 22 of the top panel 12, which corresponds to a distance in the transverse direction between said ends, is small compared to the longitudinal dimension of the top panel 12.

In particular, the transverse distance between the longitudinal end 35 of a stiffening panel 33 and the nearest longitudinal end 22 of the top panel 12 may be smaller than the transverse dimension of the first post panel 31*a* that is nearest said longitudinal end 35 of a stiffening panel 33.

Furthermore, in one possible embodiment, the free transverse end 34 of each stiffening panel 33 has the general shape of or resembles a circular arc such that a transverse length of the stiffening panel 33, which corresponds to a distance in the transverse direction between the free transverse end 34 of the stiffening panel 33 and the transverse end 21 of the top panel 12 from which the stiffening panel 33 extends, is smaller at a longitudinal median portion 36, 36*a*, 36*b* of the stiffening panel 33, 33*a*, 33*b* than at the longitudinal ends 35, 35*a*, 35*b* of the stiffening panel 33.

Thus, in one possible embodiment, the transverse length of the stiffening panel 33 can be about 4 cm to 5 cm at a longitudinal median portion 36 of the stiffening panel 33, and about 7 cm to 8 cm at the longitudinal ends 35 of the stiffening panel 33. Furthermore, in this embodiment, the transverse distance between each longitudinal end 35 of a stiffening panel 33 and the nearest longitudinal end 22 of the top panel 12 may be less than 1 cm, for example about 0.5 cm.

In the present description, a side panel is generically denoted by the reference numeral 13, a set of corner post panels by the reference 18, a transverse end of a side panel 13 by the reference 19, a longitudinal end of a side panel 13 by the reference 20, a transverse end of the top panel by the reference 21, a longitudinal end of the top panel by the reference 22, a longitudinal end of the base panel by the reference 28, a connection/deformation section by the reference 29, a longitudinal end of the sets of corner post panels by the reference 30, a post panel by the reference 31, a stiffening panel by the reference 33, a free transverse end of a stiffening panel by the reference 34, a longitudinal end of a stiffening panel by the reference 35, and a longitudinal median portion of a stiffening panel by the reference 36.

The invention also relates to a method for creating the packaging 2 and the pack 3, described more particularly with reference to the embodiment in FIGS. 1 to 6.

Figure 5A:
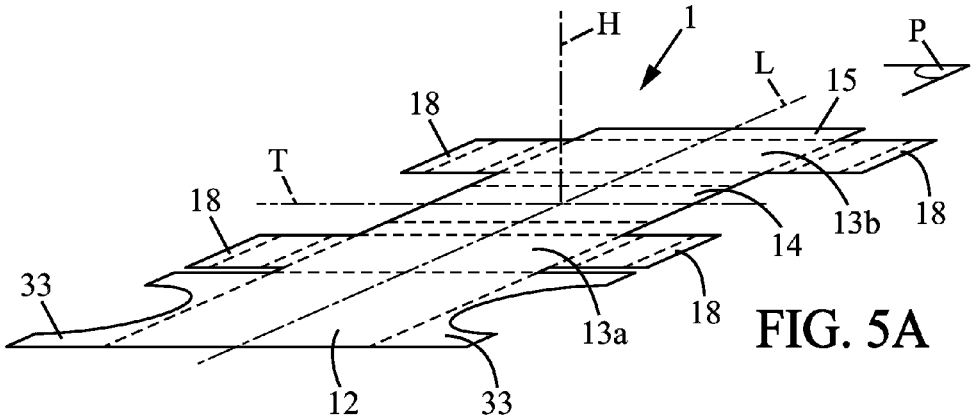
FIGS. 5A to 5E are five perspective diagrams illustrating the method for creating a pack such as the one in FIG. 2: the flat blank is shown in FIG. 5A, the arrangement of four bracing pots on the blank in FIG. 5B, the creation of the erected corner posts in FIG. 5C, the creation of the packaging in FIG. 5D, and the folding and securing of the stiffening panels in FIG. 5E.
Figure 5B:
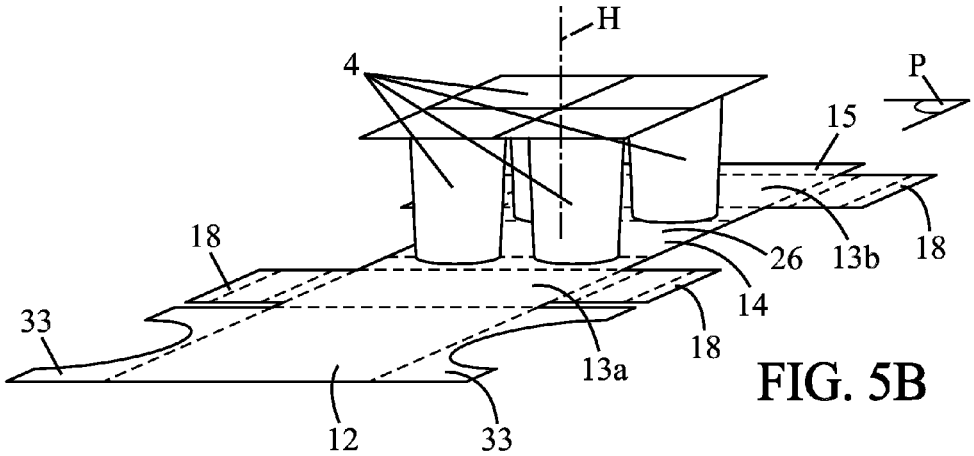
Figure 5C:
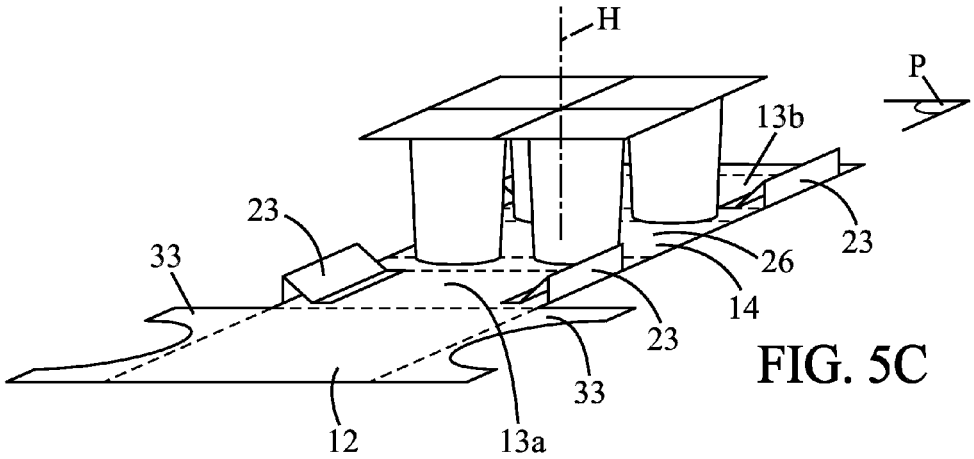
Figure 5D:
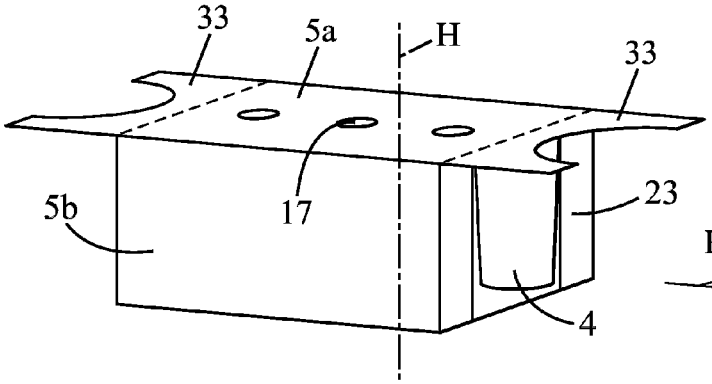
Figure 5E:
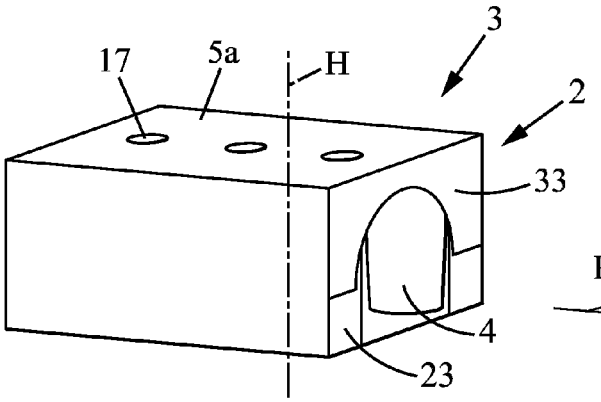

For this method, a flat blank 1 is provided, as are four base pots 4*a*, and if appropriate stacked pots 4*b*, intended to form part of the pack 3 (FIG. 5A).

Then (FIG. 5B) the four pots 4*a* are arranged in a layer of base pots on the receiving portion 26, the blank 1 being arranged so it is generally horizontal, such that the base pots 4*a* are arranged in pairs side by side and next to one another, in a square.

Then (FIG. 5C) the four corner posts are formed by folding the post panels 31 of each set of corner post panels 18 around the longitudinal score lines 25, so as to erect the sets of corner post panels 18 relative to the side panels 13.

For each set of corner post panels 18 we then have in a coplanar arrangement, for example one atop the other, and we secure to one another, the extreme post panel 31*c* to the inner surface 1*b* of the side panel 13 from which the set of corner post panels 18 extends, so as to close the erected corner post 23 on itself.

Next (FIG. 5D), the blank is formed by erecting the blank 1 around the pots 4 of the pack 3, by folding the two side panels 13, 13*a*, 13*b* around the two end base score lines 24*a*, and the top panel 12 and the closure panel 15 around the two top score lines 24*b*.

Then (FIG. 5D), in a securing step, we have in a coplanar arrangement, for example one atop the other, and we secure to one another, the top panel 12 and the closure panel 15 so as to close the erected blank 1 on itself to form the top wall 5*a*, by making use of the attachment means 14, and to form the packaging 2 surrounding the pots 4 of the pack 3.

During the formation of each erected corner post 23, the first corner post panel 31*a* pivots about the transverse end 19 of the side panel 13 to an angle of about 90°. In this manner, each first corner post panel 31*a* comes substantially into alignment with the free edge 11, two first corner post panels 31*a* arranged on the same transverse side of the blank 1 defining, with the adjacent transverse ends of the top panel and base panel, an open wall or face 6 of the erected blank 1, and therefore of the packaging 2.

Once the corner posts 23 are erected and the packaging 2 of the pack of pots is formed, one can (FIG. 5E), in an embodiment where the blank 1 comprises stiffening panels 33, fold each stiffening panel 33 over the erected corner posts 23 of the transverse ends 19 of the adjacent side panels 13 and secure each stiffening panel 33 to said erected corner posts 23 and in particular to the first post panels 31*a* of said erected corner posts 23.

The specific order of the steps and operations described above is not limiting, and in possible variants of the method for creating the packaging 2 and the pack 3, the steps and operations described above may be implemented in a different order. For example, the post formation step can be implemented before the pot arrangement step, or the blank formation step can be implemented as several successive operations, for example a first operation of folding the side panels, followed by the pot arrangement step, followed by a second operation of folding the top panel and the closure panel. These examples of variants in the sequence of the steps and operations described above are also not limiting.

The method for obtaining a packaging 2 for a pack of pots and a pack 3 of pots is similar in the case of a pack 3 having two or more layers of pots as shown in FIG. 6.

Such packaging 2 is illustrated in FIGS. 2, 3A, 3B and 5E for the case of a pack 3 having a single layer of base pots comprising four base pots 4*a*. We will now describe the packaging 2 obtained by carrying out the method, with reference to these figures.

In the packaging 2 according to this embodiment, each erected corner post 23 extends in the vertical direction H between a lower end 37 and an upper end 38. The height of an erected corner post 23, which corresponds to the distance in the vertical direction between the lower end 37 and upper end 38 of the erected corner post 23, is less than the height of the pack of pots with no load as defined above.

Thus, referring to FIG. 3A, when the pack 3 of pots is not subjected to compression in the vertical direction, the lower ends 37 of the erected corner posts 23 are not in contact with the receiving portion 26 of the blank 1.

More specifically, when the pack 3 of pots is not subjected to compression in the vertical direction, the lower ends 37 of the erected corner posts 23 can be spaced apart from the receiving portion 26 of the blank, in the vertical direction H, by a vertical separation distance substantially between about 1% to 10%, more preferably about 4%, of the height of the erected corner posts.

In these circumstances, the vertical separation distance between the lower ends 37 of the erected corner posts 23 and the receiving portion 26 of the blank may, for example, be several millimeters, for example about 5 mm.

In this manner, when the pack 3 of pots is subjected to compression in the vertical direction, the pots 4 can absorb a portion of said compression by vertical deformation, particularly by elastic deformation.

Referring now to FIG. 3B in particular, when the pack 3 of pots is subjected to compression in the vertical direction, the bottom wall 7*a* of the pots 4 of at least one layer of pots in the pack are deformed in the vertical direction such that the lower ends 37 of the erected corner posts are in contact with the receiving portion 26 of the blank.

Here, "pack of pots subjected to compression in the vertical direction" (sometimes abbreviated to "pack of pots under load") is understood to mean the pack 3 of pots 4 when subjected to compression in the vertical direction that is sufficient for the lower ends 37 of the erected corner posts to come in contact with the receiving portion 26 of the blank (arrow C in FIG. 3B). This compression may, for example, be a compression in the vertical direction exceeding 6 kg, in particular exceeding 10 kg. This compression may be applied so that it is evenly distributed over the top walls 5*a* and bottom walls 5*c* of the pack 3 of pots once the pack is formed and assembled.

This compression in the vertical direction may, for example, be a compression in the vertical direction as is as applied during implementation of the methods commonly used to measure vertical compressive strength or "VCS", for example during application of the methods as specified in the ISO 12048:1994 and ASTM D642-00 (2010) standards.

Thus, the height of the pack of pots under load, which corresponds to the distance in the vertical direction between the top closures 8 of the pots in the top layer of pots 4*c* of the pack 3 of pots, and the bottom walls 7*a* of the pots in the layer of base pots 4*a*, when the pack of pots is subjected to compression in the vertical direction, is equal to the height of the erected corner posts 23.

As illustrated in FIG. 3B, for a vertical compression (arrow C in FIG. 3B) that is greater than the vertical compression sufficient for the lower ends 37 of the erected corner posts to come in contact with the receiving portion 26 of the blank, the erected corner posts 23 contribute to the vertical compressive strength of the packaging 2 and of the pack 3 of pots such that the vertical compressive strength of the erected corner posts is added to the vertical compressive strength of the pots 4 of the pack 3 of pots. The vertical compressive strength of the packaging 2 and of the pack 3 is therefore improved.

Specifically, the shape of the erected corner posts 23 of the packaging 2 can be described as follows with reference to FIG. 4A. For each set of corner post panels 18 erected to form an erected corner post 23, the first post panel 31*a* forms an angle of approximately 90° with the side panel 13 from which the set of corner post panels 18 extends, the second post panel 31*b* forms an angle of about 45° with the first post panel 31*a*, and the extreme post panel 31*c* forms an obtuse angle of about 135° with the second post panel 31*b*. The extreme post panel 31*c* is thus substantially coplanar with the side panel 13 from which the set of corner post panels 18 extends, and in particular is secured to said side panel 13 as described above.

A cross-section of an erected corner post 23 in a plane parallel to the base panel 14 of the packaging 2 therefore has a generally triangular shape. In alternative embodiments of the invention, this cross-section may have the shape of another type of polygon, for instance a rectangle as shown in FIG. 4B, or a concave polygon.

In embodiments of the invention described above and illustrated in FIGS. 4A and 4B, in which each first corner post panel 31*a* comes substantially into alignment with a free edge 11 of the top panel and of the base panel, each stiffening panel 33 is then secured to two first post panels 31*a* of two sets of adjacent erected corner post panels 18, where appropriate at the first and second longitudinal ends 35, 35*a*, 35*b* of the stiffening panel 33.

The specific shape of the packaging 2 is adapted to the specific shape of the pots 4. The description of the packaging 2 provided above does not exclude others, in the case of pots 4 of different shapes.

In the case of a pack 3 having two or more layers of pots, the packaging 2 as a whole is similar to that for a pack 3 with a single layer of base pots, except that its dimension along axis H is larger to adapt to the number of layers.

In the case of a pack 3 in which the layer of base pots comprises more or less than eight base pots 4*a*, the packaging 2 as a whole is similar to that for a pack 3 having a layer of base pots consisting of four base pots 4*a*, except that its transverse dimension is larger or smaller and is in keeping with the number of longitudinal rows of base pots 4*a*.

The invention also relates to a pack 3 comprising a layer of base pots 4*a* of the type described above, and packaging 2, as has been described.

In such a pack 3, the bottom walls 7*a* of the base pots 4*a* are received on the receiving portion 26, the top wall 5*a* rests against or is adjacent to the closure 8 of the pots of the pack 3 forming part of the top layer 4*c* of pots, which is the highest layer of pots in the pack 3 of pots in the vertical direction H, as illustrated in FIGS. 3A and 3B.

"The top wall rests against or is adjacent to the closure of the pots of the pack" is understood to mean that either the top wall 5*a* rests against and is in close contact with the closure of the pots in the top layer of pots 4*c* of the pack of pots, or that the top wall 5*a* is in immediate proximity to the closure of the pots of the top layer of pots 4*c* of the pack of pots—for example spaced vertically apart by a fraction of a millimeter or by a few millimeters. In particular, this phrase is understood to mean that the vertical distance between the top wall 5*a* and the closure 8 of the pots in the top layer of pots 4*c* of the pack of pots is less than the vertical separation between the lower ends 37 of the erected corner posts 23 and the receiving portion 26 of the blank, when the pack 3 of pots is not subjected to compression in the vertical direction.

In one possible embodiment illustrated in FIGS. 3A and 3B, the bottom walls 7*a* of the pots 4 of at least one layer of pots of the pack 3 may be rounded and able to deform elastically in the vertical direction H when the pack 3 of pots is subjected to compression in the vertical direction. This compression may, for example, be a vertical compression exceeding 6 kg, in particular exceeding 10 kg. This compression may in particular be applied so it is uniformly distributed over the top 5*a* and bottom 5*c* walls of the pack 3 of pots, and be, for example, a compression as is applied during implementation of the methods commonly used to measure vertical compressive strength or "VCS", for example during implementation of the methods as specified in the ISO 12048:1994 and ASTM D642-00 (2010) standards.

In one possible variant, which can be combined with the previous embodiment, the side walls 7*b* of the pots 4 of at least one layer of pots in the pack may be able to deform elastically in the vertical direction when the pack of pots is subjected to this same compression in the vertical direction.

Here, the phrase "the side walls of the pots of at least one layer of pots in the pack may be able to deform elastically in the vertical direction" is understood to mean that said side walls can deform by bending relative to their shape when in a pack of pots with no load, such that the vertical dimension of the pack 3 of pots is reduced. In particular, these walls may deform by flexure about a horizontal direction.

Depending on the embodiments, the pots 4 may or may not comprise a flange 9 near the opening and may or may not be connected to each other by their flanges 9. When the pots 4 comprise a flange 9, these flanges 9 may have a shape 39 that is complementary to a shape 40 of the erected corner posts 23, in particular a geometric shape with angled corners 39.

In one embodiment shown in FIG. 4A, where the sets of corner posts 18 comprise three post panels 31, 31*a*, 31*b*, 31*c*, the flanges 9 of the pots may have angled corners 39*a* that cooperate with the two panels 31*b* of the erected corner posts 23.

This complementarity of the shape 39 of the pot flanges 9 and the shape 40 of the erected corner posts 23 thus allows generally immobilizing the pots 4 in translation on the receiving portion 26, meaning in the plane P of the receiving portion 23. In this manner it is possible to prevent the accidental escape of the pots 4 through the open faces 6 at opposite ends of the packaging 2.

The shape, the layout, the dimensions of the component parts of the blank 1 and of the final form 2, including the receiving portion 26, of the corner posts 23, and of the connection/deformation sections, and the shape 29, the layout, the dimensions of the pots 4 are compatible, such that, inside the packaging 2, the flanges 9 of the pots 4 are adjacent to the corner posts 23.

In particular, for each layer 4 of pots 4 in the pack 3 of pots, the four pots 4*d* of said layer which each respectively constitute the pot 4 of the pot layer adjacent to each of the erected corner posts 23, may each include a flange 9 having a shape 39 complementary to a shape 40 of the associated erected corner post 23. In this manner, a general immobilization can be obtained of the pot layer, in translation relative to the plane of the receiving portion 26.

In an alternative embodiment illustrated in FIG. 4B, the flanges 9 of the pots adjacent to the posts 23 each have a point of contact 39*b* with the adjacent erected corner post 23.

The term "adjacent", when concerning the four pots 4*d* and each of the corresponding erected corner posts 23, is understood to mean that, depending on the circumstances—and in particular the clearance between the pots 4*d* and the erected corner posts 23: the flange 9 of a pot 4*d* is in contact with the corresponding erected corner post 23, possibly with—if appropriate—a certain applied force, so as to prevent the pot 4*d* from traveling in one direction; or that the flange 9 is simply close to the erected corner post 23—for example a fraction of a millimeter or a few millimeters away—so that movement of the pot 4*d* toward the erected corner post 23 is limited to the small distance separating the flange 9 and the corresponding corner post 23, and that at the end of any movement of the pot 4*d*, the flange 9 comes in contact with the erected corner post 23 and stops the pot 4*d* from traveling in the direction of the corresponding erected corner post 23.

The general immobilization can be further improved when the pots 4 of one or all layers of pots 4 are connected to each other by their flanges 9.

"General immobilization of pots in translation" and "general immobilization of the pot layer" are understood to mean that, in the pack 3 or in the layer of pots 4, the pots 4 are prevented at least to some extent from moving unexpectedly relative to the packaging 2, and in particular are prevented from accidentally escaping through the open faces 2 at opposite ends of the packaging 2. It is understood in particular that a relative movement of the pots 4 relative to each other and to the packaging 2 can be allowed but limited to a displacement of less than a maximum displacement, for example a displacement of less than the diameter of the cylindrical side wall 7*b*, for example a displacement of less than a maximum displacement of about 6 cm to 9 cm.

The invention also relates to a production line for creating a pack 3 as described above.

Such a line comprises means for providing flat blanks 1. It also comprises means for providing pots 4 intended to be part of the pack 3.

Such a line also comprises conveying means associated with the means for providing flat cardboard blanks and the means for providing pots, this conveying means being arranged generally horizontally and being suitable for conveying flat blanks, blanks with pots resting on them, and packaging materials 2, with functional means along its length.

These functional means firstly comprise, from upstream to downstream, means for gripping, moving, and arranging base pots 4*a*, suitable and intended for arranging these pots 4*a* on the receiving portion 18 of the blanks 1 on the conveying means.

These functional means secondly comprise folding means, suitable and intended for erecting the sets of corner post panels 18 relative to the side panels 13 of the blanks, so as to form the erected corner posts 23 by folding the panels 31 of the sets of corner post panels 18 around longitudinal score lines 25.

These functional means thirdly comprise folding means, suitable and intended for erecting the blanks 1 around the pots 4 by folding the side panels 11 around end base score lines 24*a*, and the top panel 12 and the closure panel 15 around top score lines 24*b*.

These functional means fourthly comprise closure and securing means, suitable and intended for placement in a coplanar arrangement and for securing the top panel 12 and the closure panel 15 to each other, and for forming a packaging 2 surrounding the pots 4 and a pack 3 and pots 4.

Lastly, these functional means comprise means for removing the packs.

The invention claimed is:

1. A flat blank, for forming a packaging for a pack of pots, the pots having a bottom wall, a side wall closed on itself, and a top closure, the pack including at least one layer of base pots, the blank being of a tubular shell type of cardboard or the like, comprising:

side-by-side in a longitudinal direction: a top panel, two side panels, a base panel, a closure panel, and a securing device configured to close the erected blank on itself;

transverse score lines, extending in a transverse direction substantially perpendicular to the longitudinal direction, for folding the panels, for erecting the blank, and for forming the packaging and the pack;

four sets of corner post panels, each set of corner post panels extending from a transverse end of a side panel and able to be erected relative to said side panel to form an erected corner post; and longitudinal score lines for folding the panels of the sets of corner post panels, for erecting the sets of corner post panels, and for forming the erected corner posts, wherein the base panel comprises arranged one after the other in the longitudinal direction between a first longitudinal end and a second longitudinal end of the base panel:

a first connection/deformation section, a receiving portion extending over a portion of the base panel, for receiving the bottom walls of the base pots, and a second connection/deformation section, and two intermediate base score lines extending in the transverse direction between the first and second connection/deformation sections and the receiving portion, so that the receiving portion is formed by a longitudinally median transverse portion of the base panel, and is bounded transversely on the base panel by the two intermediate base score lines extending in the transverse direction, the intermediate base score lines defining, with the longitudinal ends of the base panel, the first and second connection/deformation sections extending over the base panel on each side of the longitudinally median receiving portion of the base panel, the intermediate base score lines forming two deformable hinges, such that the longitudinally median receiving portion of the base panel is movable relative to the longitudinal ends of the base panel along an axis perpendicular or substantially perpendicular to the receiving portion after erection of the blank and formation of the packaging and the pack.

2. The flat blank according to claim 1, wherein a longitudinal dimension of a connection/deformation section, that is a distance between the intermediate base score line and the longitudinal end of the base panel defining the connection/deformation section, is between about 2% to 20% of a longitudinal dimension of the base panel that is a distance between the longitudinal ends of the base panel.

3. The flat blank according to claim 1, further comprising:

two free edges in the longitudinal direction and two free edges in the transverse direction;

arranged one after the other in the longitudinal direction: a top panel, a first side panel, a base panel, a second side panel, a closure panel with a securing device configured to secure the top panel to the closure panel in order to close the erected blank on itself with formation of a top wall; and two end base score lines, between the base panel and the two side panels, and two top score lines, between the top panel and the closure panel and the two adjacent side panels.

4. The flat blank according to claim 1, wherein the sets of corner post panels are substantially within the extension of the side panels, at transverse ends thereof.

5. The flat blank according to claim 4, wherein the side panels are substantially rectangular and each extend between a first and a second longitudinal end which are substantially rectilinear and parallel to each other, and between a first and a second transverse end which are substantially rectilinear and parallel to each other, the sets of corner post panels are substantially rectangular and each extend from a transverse end of a side panel between a first and a second longitudinal end which are substantially rectilinear and parallel to each other, and the first and second longitudinal ends of the sets of corner post panels are substantially within the extension of the first and second longitudinal ends of the side panels.

6. The flat blank according to claim 1, wherein each set of corner post panels comprises at least three substantially rectangular post panels extending between the first and second longitudinal ends of said set of corner post panels, the post panels lie side by side in the transverse direction from one transverse end of a side panel from which the set of corner post panels extends, to a free transverse end of the set of corner post panels, a first post panel being connected to the transverse end of the side panel, the post panels are separated from each other and from the side panel by longitudinal score lines, for folding the post panels, for erecting the sets of corner post panels, and for forming the erected corner posts.

7. The flat blank according to claim 6, wherein each set of corner post panels comprises at a transverse free end thereof an extreme post panel, configured to attach to the side panel from which the set of corner post panels extends, after the set of corner post panels is erected.

8. The flat blank according to claim 6, wherein each set of corner post panels comprises, arranged one after the other in the transverse direction and separated by longitudinal score lines, a first post panel, a second post panel, and an extreme post panel, a transverse dimension of the first post panel that is the distance between the longitudinal score lines separating the first post panel from the second post panel and from the side panel is less than a transverse dimension of the second post panel that is the distance between the longitudinal score lines separating the second post panel from the first post panel and from the extreme panel post.

9. The flat blank according to claim 8, wherein the transverse dimension of the first post panel is between about 50% to 90% of the transverse dimension of second post panel.

10. The flat blank according to claim 1, wherein each side panel is a single rigid portion.

11. The flat blank according to claim 3, wherein a longitudinal dimension of a side panel that is a distance between the end base score line and the top score line of the side panel is less than a height of the pack of pots with no load, and a distance between the closures of the pots in the highest layer of the pack of pots in the vertical direction, and the bottom walls of the pots of the layer of base pots, when the pack of pots is not subjected to compression in the vertical direction.

12. The flat blank according to claim 11, wherein the longitudinal dimension of the side panel is between about 90% to 99% of the height of the pack of pots with no load.

13. The flat blank according to claim 3, wherein a longitudinal dimension of the base panel that is a distance between the end base score lines is substantially less than or equal to a longitudinal dimension of the top wall of the packaging, and is substantially equal to or less than a longitudinal dimension of the top panel that is a distance between the free transverse edge and the top score line of the top panel.

14. The flat blank according to claim 1, further comprising two stiffening panels each extending from a transverse end of the top panel.

15. The flat blank according to claim 14, wherein the top panel is substantially rectangular and extends between a first longitudinal end and a second longitudinal end which are substantially rectilinear and parallel to each other, and between a first transverse end and a second transverse end which are substantially rectilinear and parallel to each other, the stiffening panels each extend from a transverse end of the top panel to a free transverse end, and extend between a first longitudinal end and a second longitudinal end which are substantially rectilinear and parallel to each other, and the first and second longitudinal ends of the stiffening panels are substantially within the extension of the first and second longitudinal ends of the top panel.

16. A method for creating a pack of pots, the pots being of the type having a bottom wall, a side wall closed on itself, and a top closure, the pack including at least one layer of base pots and, optionally, one or more layers of pots stacked vertically on top of the layer of base pots, packaged in packaging created from a flat blank erected and closed on itself, wherein:

the flat blank according to claim 1 is provided, pots intended to be part of the pack are provided, in a pot arrangement step, the pots are placed on the blank in at least one layer of base pots, and optionally one or more layers of pots stacked in a height direction on top of the layer of base pots, so that the bottom walls of the base pots are received on the receiving portion of the blank, in a post formation step, four sets of corner post panels are erected relative to the side panels so as to form four erected corner posts by folding the panels of the sets of corner post panels around longitudinal score lines, in a blank formation step, the blank is erected around the pots by folding the side panels, the top panel, and the closure panel around transverse score lines, then, in a securing step, the closure panel is secured so that it closes the erected blank on itself, thus forming the packaging for the pack of pots as well as the pack of pots.

17. The method for creating a pack of pots according to claim 16, wherein the extreme post panels of the sets of corner post panels are secured to the side panels.

18. The method for creating a pack of pots according to claim 16, wherein the first corner post panel pivots about the transverse end of the side panel to an angle of about 90°.

19. The method for creating a pack of pots according to claim 16, wherein each stiffening panel is folded over the erected corner posts of the transverse ends of the adjacent side panels and each stiffening panel is secured to said erected corner posts.

20. A packaging obtained by implementing a method according to claim 16, wherein each erected corner post extends in the vertical direction between a lower end and an upper end, and wherein a height of an erected corner post—a distance in the vertical direction between the lower end and the upper end of the erected corner post—is less than a height of the pack of pots with no load—a distance in the vertical direction between the closures of the pots in the vertically highest layer of pots of the pack of pots, and the bottom walls of the pots of the layer of base pots, the pack of pots not being subjected to compression in the vertical direction.

21. The packaging according to claim 20, wherein, when the pack of pots is not subjected to compression in the vertical direction, the lower ends of the erected corner posts are not in contact with the receiving portion of the blank.

22. The packaging according to claim 21, wherein the lower ends of the erected corner posts are distanced from the receiving portion of the blank, in the vertical direction, by a substantially vertical separation distance of between about 1% to 10%, more particularly about 4%, of a height of the erected corner posts—a distance, in the vertical direction, between the lower ends and the upper ends of the erected corner posts.

23. The packaging according to claim 20, wherein, when the pack of pots is subjected to compression in the vertical direction, the bottom walls of the pots of at least one layer of pots of the pack are deformed in the vertical direction such that the lower ends of the erected corner posts are in contact with the receiving portion of the blank.

24. The packaging according to claim 23, wherein a height of the pack of pots under load—a distance, in the vertical direction, between the top closures of the pots in the vertically highest layer of pots of the pack of pots, and the bottom walls of the pots in the layer of base pots, said pack of pots being subjected to compression in the vertical direction—is equal to a height of the erected corner posts—a distance, in the vertical direction, between the lower ends and the upper ends of the erected corner posts.

25. The packaging according to claim 20, wherein the compression in the vertical direction exceeds 6 kg, in particular exceeds 10 kg.

26. The packaging according to claim 20, wherein, for a set of corner post panels erected to form an erected corner post, the first post panel forms an angle of about 90° with the side panel from which the set of corner post panels extends, the second post panel forms an angle of about 45° with the first post panel, the extreme post panel forms an obtuse angle of about 135° with the second post panel, and is substantially coplanar with the side panel from which the set of corner post panels extends.

27. A pack of pots including at least one layer of base pots and, optionally, one or more layers of pots stacked vertically on top of the layer of base pots, the pots being of the type having a bottom wall, a side wall closed on itself, and a top closure; and a packaging according to claim 20, wherein:

the bottom walls of the base pots are received on the receiving portion, and the top wall rests against or is adjacent to the top closure of the pots in the vertically highest layer of pots of the pack of pots.

28. The pack according to claim 27, wherein the bottom walls of the pots of at least one layer of pots of the pack are rounded and able to deform elastically in the vertical direction and/or the side walls of the pots of at least one layer of pots of the pack are able to deform elastically in the vertical direction when the pack of pots is subjected to compression in the vertical direction.

29. The pack according to claim 27, wherein the layer of base pots consists of at least eight base pots.

30. A production line for creating a pack of pots according to claim 27, comprising:

means for providing flat blanks according to, means for providing pots intended to be part of the pack, conveying means associated with the means for providing flat cardboard blanks and the means for providing pots, said conveying means being arranged generally horizontally and being suitable for conveying flat blanks, blanks with pots resting on them, and packaging materials, with functional means along its length comprising:

means for gripping, moving, and arranging pots, suitable and intended for arranging the pots in at least one layer of base pots, and optionally one or more layers of pots stacked in a height direction on top of the layer of base pots such that the bottom walls of the base pots are received on the receiving portion of the blanks on the conveying means, folding means, suitable and intended for erecting the sets of corner post panels relative to the side panels of the blanks, so as to form the erected corner posts by folding the panels of the sets of corner post panels around the longitudinal score lines, folding means, suitable and intended for erecting the blanks around the pots by folding the side panels, top panels, and closure panels around the transverse score lines, closure and securing means, suitable and intended for securing the closure panels so as to close the erected blanks on themselves and thus form the packaging for packs of pots as well as the packs of pots, and means for removing the packs.

* * * * *